United States Patent [19]

Whitehurst et al.

[11] 4,347,116

[45] Aug. 31, 1982

[54] TWO-STAGE COAL LIQUEFACTION

[75] Inventors: Darrell D. Whitehurst, Titusville; Thomas O. Mitchell, Trenton; Malvina Farcasiu, Princeton, all of N.J.

[73] Assignee: Mobil Oil Corporation, New York, N.Y.

[21] Appl. No.: 903,911

[22] Filed: May 8, 1978

[30] Foreign Application Priority Data

Jun. 8, 1977 [GB] United Kingdom ..... 23951/77

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS 3,663,420 5/1972 Jacobs et al. ..... 208/8 LE
3,841,991 10/1974 Cohen et al. ..... 208/8 LE
3,852,182 12/1974 Sze ..... 208/8 LE
3,997,425 12/1976 Gotsis et al. ..... 208/8 LE

FOREIGN PATENT DOCUMENTS 965720 4/1975 Canada ..... 208/8 LE
1287570 8/1972 United Kingdom ..... 208/8 LE

*Primary Examiner*—Delbert E. Gantz
*Assistant Examiner*—William G. Wright
*Attorney, Agent, or Firm*—Scully, Scott, Murphy & Presser

[57] ABSTRACT

Two-stage coal liquefaction is improved by separating a light fraction from the first (dissolving) stage effluent, hydrogenating that fraction and reblending the hydrogenated light fraction with the material passed from the first stage to the second stage reactor operating at higher temperature than the first stage.

3 Claims, 1 Drawing Figure

TWO-STAGE COAL LIQUEFACTION

FIELD OF THE INVENTION

The invention concerns improvement in solvent refining of coal whereby components of coal suitable for fuel are extracted from comminuted coal by a solvent and recovered as a low melting point mixture of reduced sulfur and mineral matter content adapted to use as fuel in conventional furnaces. In the type of operation to which the invention is directed, the solvent is derived from the product extract and applied to the raw coal feed.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen donor solvent and hydrogen gas in order to remove the mineral matter, lower the sulfur content of the coal, and to convert it into a low melting solid which can be solubilized in simple organic solvents. This SRC can also be upgraded through catalytic hydrogenation to produce a liquid of higher quality. These two processes are of concern to the present invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality, specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreached residue, and excessive char formation, which often completely plugs process transfer lines and reactors.

Alternative methods of improving specifications through catalytic hydrogenation are also difficult. The problems which arise are threefold. (1) SRC components are susceptible to further condensation and may deposit as coke on catalysts used for their conversion, (2) they can also foul the catalysts by physical blockage as their size approaches the pore size of conventional catalysts, and (3) they may contain metal contaminants, and their highly polar nature (particularly nitrogenous and sulfur compounds) can lead to selective chemisorption, and thus poison the catalysts.

The precise chemical nature of the SRC is still unknown; generally its composition is discussed in terms of solubility. Several classifications are commonly used.

These include oils which are hexane or pentane soluble, asphaltenes which are benzene soluble, and pyridine soluble-benzene insoluble materials. Of these the asphaltenes and pyridine soluble-benzene insoluble materials are believed to be responsible for high viscosity, solvent incompatability, and processing difficulties. Little is known about the pyridine soluble-benzene insoluble materials. These have been referred to as "pre-asphaltenes" which implies that asphaltenes are derived from them; however, this has yet to be established.

More information is available on the nature of asphaltenes. It is common experience that coal liquids contain large quantities of materials known as asphaltenes. In fact, it has even been suggested that the formation of asphaltenes is a necessary step in the liquefaction of coal.

The term asphaltene is a rather nebulous and all-inclusive classification of organic materials for which a detailed chemical and physical identification is quite difficult, and has not yet been accomplished.

This classification generally refers to high molecular weight compounds, boiling above 650° F., which are soluble in benzene and insoluble in a light paraffinic hydrocarbon (e.g., pentane). Usually no distinction is made regarding polarity, as the term has been used customarily in the characterization of heavy petroleum fractions (resids, etc.) where the amount of highly polar materials is small. However, in coal liquids this may not necessarily be the case due to the high degree of functionality of coal itself. Thus, coal liquids of low molecular weight may still be "asphaltenes". There is considerable variation in the molecular weight of solubilized coals which arises from differences in the parent coals, or different solvent or solvent-reactant systems at the same temperature of reaction. This could well be related to colloidal properties of coal liquids. It is well documented that asphaltenes found in heavy petroleum fractions are colloidal in nature.

Some comments on the chemical nature of coal asphaltenes have recently been made. Asphaltenes from Synthoil Process liquids were separated into a basic fraction (containing oxygen only as ether or ring oxygen and basic nitrogen as in pyridine) and an acidic fraction (containing phenolic OH and nitrogen as in pyrrole). The two fractions were found to have very different properties. The basic fraction could be hydrotreated only with difficulty, while the acid fraction underwent facile hydrotreating. This is consistent with reported data on the influence of nitrogen heterocycles on conventional hydroprocessing.

Based on these results an acid-base pair structure for asphaltenes was proposed and this structure was extrapolated to that of coal itself. This structure is quite different from the more amphoteric nature of coal which has been proposed previously.

Mechanisms have been proposed for the noncatalyzed formation of asphaltenes from coal. In this work it was concluded that asphaltenes were a necessary product of coal liquefaction and that oils were derived from asphaltenes. The more polar pyridine soluble materials were not investigated and were assumed to be equivalent to unreacted coal. The maximum yield of asphaltenes was found, however, to be a function of the conditions of coal conversion; hydrogen donor solvents greatly reduced the propensity for formation of asphaltenes at low conversion. In addition, it was not determined whether the asphaltene fractions resulting from different conditions were of the same chemical and/or physical nature. Thus, asphaltenes may be inherent constituents of coal products or they could well be the result of either thermal or catalytic transformations of more polar materials.

In considering what may be involved in the formation of asphaltenes during coal solubilization or conversion, it may be instructive to consider what is known of coal structure. Coal is a rather complicated network of polymeric organic species, the bulk of which is porous in the natural form; the pore system varies from coal to coal. Depending upon the specific nature of the porous structure of each coal, its chemical constituents, and the reaction conditions, the rate of diffusion and mass transport of organic molecules through the pores could have a strong effect on the rates of dissolution, hydrogen transfer, and hydrogenation and hydrocracking reactions, and thus on the ultimate yield of soluble product.

As the rank of coal becomes higher, an increasing number of colloidal size aggregates (20–50 Å) can be observed by X-ray scattering and diffraction.

If, in the early stages of the dissolution of coal these colloidal aggregates dissociate to some degree and go into solution, the molecular weight of the lowest unit appears to be consistent with the lowest molecular weights observed in solublized coals (~500 MW). This comparison may be coincidental, however. Unfortunately, in order to dissolve coal it is generally found that temperatures in excess of 300° C. are necessary. It is also known that coal begins to pyrolize and evolve volatile matter at temperatures as low as 250° C. (depending on rank), and by 350° C. considerable material has evolved. This strongly suggests that extensive internal rearrangement of the coal occurs during the dissolution process. Rearrangement can include hydrogen migration to produce highly condensed aromatic rings as well as further association of small colloidal aggregates or condensation of reactive species. Major physical changes in the pore system of the solid coal have also been reported.

This rearrangement could possibly be responsible for some of the very high molecular weights (~3000 MW) observed with some solvents. No detailed relationships of solvent type and/or reaction condition to the molecular weight distribution of solubilized coal has yet been established. Similarly, the possibility of reversible molecular weight changes, due to recondensation causing increased molecular weights at various temperatures, has not been investigated thoroughly.

An alternative route to high molecular weight is through the catalytic influence of inorganic coal minerals which are present in the processing of coal. It is known that some coals are more reactive than others, producing higher yields of liquid products at shorter residence times. It is believed that this is due to the fact that the initial coal products are reactive and condense to char unless proper reaction conditions are established. This further condensation could well be a catalytic phenomenon induced by intrinsic coal minerals.

Another more subtle consequence of certain inorganic constituents is their influence on the physical properties of pyrolytic coal chars, and thus on the diffusional properties imposed on reactive intermediates. The volume of char has been observed to vary by a factor of four or more, with little change in weight, by varying the type of inorganic contaminants in a given bituminous coking coal. The pore system of the resultant chars must be vastly different and changes of this type magnitude in the physical structure of the coal or char could greatly influence mass transport of intermediates produced within the pore system. Mass transfer limitation during the pyrolysis and hydrogasification of some coals at high temperatures has recently been established. This study showed that for some coals, reactive primary products are formed which can recombine to produce char if the conditions are not properly adjusted. The criticality was found to be the rate of diffusion of the reactive species out of the coal relative to its rate of conversion to char.

At lower temperatures, the rates of reaction are, of course, slower and thus less susceptible to mass transport limitations. However, the imposition of a liquid phase, commonly used in liquefaction processes, may greatly enhance diffusional restrictions. Recent model studies conducted in aqueous systems, have shown that restriction of diffusion through porous structures with pore radii ranging from 45 Å to 300 Å for even relatively small solute molecules is very significant.

At the present stage of the art, the accumulated information is largely empirical, with little basis for sound extrapolation to predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

SUMMARY OF THE INVENTION

We have found that in two-stage coal liquefaction schemes, various factors in solvent composition are important. Advantage can be realized by their proper use and control.

The extent of solvent hydrogenation affects SRC solubility in solvents. Thus, hydrogen-poor solvents are better physical solvents, especially in the first stage. Phenols having 10 or more carbons can be hydrogen donors; phenols in solvents can condense with SRC's, especially in the first stage, but the condensation can be reversed and the phenols can be recovered again, especially in the second stage. The rate of solvent rehydrogenation may be the controlling factor in the rate at which coal can be processed (coal residence time in system).

According to the invention, hydrogenation of a portion of the solvent between the stages takes advantage of these factors as follows. After the slurry leaves the first-stage reactor, the gases and lower-boiling materials up to and including about $C_{14}$ compounds (~275° C.) are flashed off and passed through a catalytic hydrogenator. In this step, naphthalene and its homologs are converted to tetralin and its homologs, and phenols having a single aromatic ring are destroyed. This stream is then sent to the second stage along with the majority of the solvent that had not been flashed off. Thus, the solvent to the second stage has reduced light phenols, increased hydro-aromatics, and still contains the heavier phenols that are hydrogen donors. There are thus two advantages. First, the solvent is an excellent donor, and second, the solvent is less phenolic and so the SRC will be less phenolic, will consume less hydrogen in its upgrading, and will be more compatible with highly-upgraded or petroleum stocks. An important point is that the solvent initially entering the second stage has sufficient donor ability to achieve SRC upgrading by hydrogen transfer reactions and does not have to be regenerated in the second stage. Thus, the residence time in the second stage can be shorter. The hydrogenated solvent is needed only in the second stage and hydrogenation is done just before this stage. On exit from the second stage, the solvent can be considerably depleted in hydrogen so long as depletion is not so severe that char formation occurs near the end of the second stage. This hydrogen-poor solvent is suitable for recycle to the first stage where hydrogen donor capacity requirements are minimal. Furthermore, this solvent is more aromatic and phenolic (phenols are produced in SRC upgrading, partly by reversal of the condensation that occurred in the first stage), and so a better physical solvent for initially-solubilized coal products formed in the first stage.

This scheme can be coupled with several variations of the procedure for solids removal. An important role of the coal mineral matter in the SRC process is catalysis of solvent rehydrogenation. This is not required according to the invention. Therefore, solids can be removed entirely between the stages by any of the known techniques (centrifugation, settling, filtration, anti-solvent precipitation, etc.). Optionally, the flash to remove light material for catalytic hydrogenation can be done before or after the separation. This can help control factors important to the optimal operation of the various separation techniques (percent solids, viscosity, total slurry volume, solvent polarity, etc.). Another option, again depending upon the separation technique used, is to return the rehydrogenated solvent to the system before the solids separation step.

BRIEF DESCRIPTION OF DRAWING

These and other objects and advantages of the invention will be more fully understood by consideration of specific embodiments described below with reference to the annexed drawing wherein.

DESCRIPTION OF SPECIFIC EMBODIMENTS

Figure 1:
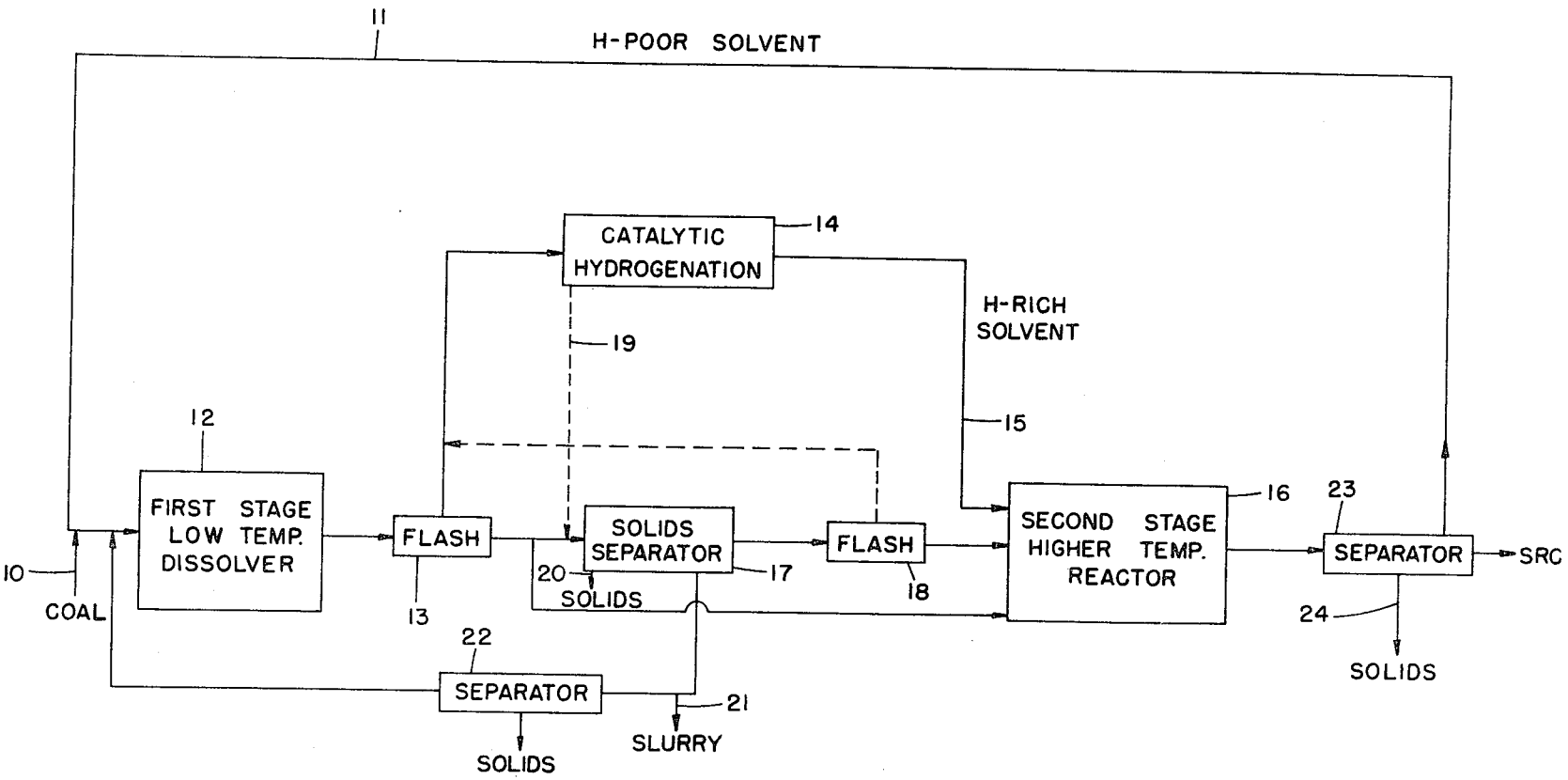
FIG. 1 is a diagrammatic flow sheet representation of apparatus suited to practice of the invention.

The process of this invention can even be conducted without the atmosphere of hydrogen pressure normally used in processes for solvent refining of coal with a solvent derived at least in part from the product. For that reason, solid residues of ash components, unreacted coal, iron sulfides, coke and the like may be separated at any desired stage of the process as will appear from the detailed discussion below. This added flexibility is achieved in a process sequence affording increased efficiency in utilization of hydrogen and increased throughput (or decreased reactor size). In processes of the prior art, the solids are retained in the reaction mixture for catalytic effect in hydrogenation of chemical species, such as naphthalene, which become hydrogen donors, e.g. tetralin, on hydrogenation to suppress formation of char by transfer of hydrogen to polymerizable fragments formed in dissolution of coal.

The flow sheet of FIG. 1 can be considered with reference to solvent refining of Monterey Mine, Illinois #6, a typical bituminous coal. Inspection data on that coal are shown in Table I.

TABLE I

| | |
|---|---|
| Name of Coal | Illinois #6 |
| Mine | |
| Location | |
| State | Illinois |
| County | Macoupin |
| Seam | 6 |
| Name of Mine | Monterey |
| Proximate Analysis* | |
| % Moisture (as rec.) | 12.81 |
| % Ash (as rec.) | 9.43 |
| % Volatile Matter | 41.73 |
| % Fixed Carbon | 47.45 |
| BTU (as rec.) | 10930. |
| BTU | 12536. |
| Free Swelling Index | |
| Ultimate Analysis* | |
| % C | 69.72 |
| % H | 4.98 |
| % O** | 8.20 |
| % N | 1.08 |
| % S (total) | 5.14 |
| % S (pyritic) | 2.26 |
| % S (organic) | 2.70 |
| % S (sulfate) | 0.18 |
| % Cl | 0.06 |
| % Ash | 10.82 |

*All analyses are given on a dry weight basis unless otherwise stated.
**By difference Petrographic Analysis

| Vitrinite | Pseudovitrinite | Exinite | Fusinite | Semifusinite | Massive Micrinite | Granular Micrinite | Resinite | Total |
|---|---|---|---|---|---|---|---|---|
| 89 | 3 | 1 | 1 | 1 | 2 | 2 | 1 | 100 |

Mean Maximum Reflectance in Oil (564 nm): 0.47%

For processing in accordance with the invention, the coal of Table I will be ground to pass 100–200 mesh standard screen, maximum particle size of about 0.15–0.07 mm. The comminuted coal will be admitted to the process at line 10 for admixture with approximately 1–6 parts by weight of a hydrogen-poor solvent derived in the process and recycled by line 11. The mixture passes to a first stage low temperature dissolver 12 where it is maintained at a temperature of about 400°–460° C. for a residence time of about 1–10 minutes.

The solvent at this first stage will be rich in potent solvents such as polycyclic aromatics, phenols and the like which rapidly dissolve soluble components of the coal. In addition, other transformations will take place, such as alkylation of phenols by coal fragments. The slurry from first stage dissolver 12 will be passed to flash separator 13 where the pressure is reduced to a level to vaporize components up to and including hydrocarbons having 14 carbon atoms, i.e. atmospheric boiling points of about 275° C. and lower. Suitable conditions for flash separator 12 may be 150–450 pounds per square inch gauge (psig) and 350°–460° C.

Overhead from flash separator 13 is conducted to catalytic converter 14 where it is admixed with hydrogen and contacted with a hydrogenation catalyst such as cobalt/molybdenum on alumina under conditions to remove single ring phenols by conversion to hydrocarbons and to generate hydrogen donors by hydrogenation of polycyclics, e.g. naphthalene to tetralin. Suitable conditions are 5–50 standard cubic feet of hydrogen per pound of distillate from flash separator 13, pressure of 500–2500 psig and temperature of 260°14 400° C. The product is light solvent rich in hydrogen as hydrogen donor compounds and depleted in monocyclic phenols which is passed by line 15 for use in the process according to a manner presently to be described.

The liquid fraction from flash separator 13 is transferred to second stage reactor 16 which operates at a temperature equal to above that of dissolver 12, say 400°–480° C. and 500–3000 psig. An alternative to direct transfer which can offer significant advantage is to separate solids from the dissolved coal between stages in solids separator 17. Because further solids separations are feasible, the operation of separator 17 may be relatively inefficient, such as a simple settling chamber of low residence time, say 15–300 seconds. Depending on factors important to optimal operation of the various separation techniques (percent solids, viscosity, total slurry volume, solvent polarity, etc.), the flash separation may be conducted in flash separator 18 subsequent to solids separation instead of, or in addition to action of flash separator 13. On like considerations, hydrogenated light solvent from reactor 14 may be added in whole or part to the slurry entering solids separator 17, as indicated by broken line 19.

Depending on efficiency of separation in separator 17, if used, solids may be withdrawn from the system by line 20, or a slurry may be taken off to be discharged as such at line 21 or settled (or centrifuged or filtered) in separator 22 with return of clarified liquid to the inlet of first stage dissolver 12.

The effluent of first stage dissolver 12 from which a light fraction has been removed by flash separator 13 or 18 and containing more or less solids, depending whether solids separator 17 is employed and at what efficiency, will now be introduced to second stage reactor 16 where it is admixed with hydrogen rich solvent from line 15. In reactor 16, the process of producing solvent refined coal is completed by conventional reactions, but under conditions superior to those previously proposed. Reactor 16 may be maintained at 400°–480° C. and 500–3000 psig of $H_2$ for a residence time of about 5–120 minutes. To the extent coal fragments have not previously equilibrated as to hydrogen content, that reaction will now be completed in the presence of hydrogen "shuttling" agents like polycyclic phenols, naphthalenes, anthracenes and substitution products thereof which accept protons from hydrogen rich fragments and confer the same on hydrogen poor fragments. Fragments which have alkylated phenols at an earlier stage will reappear by dealkylation under an environment which inhibits polymerization of these potential char precursors because of the concentration of hydrogen donors.

The hydrogen donors of relatively low molecular weight derived from hydrogenation in reactor 14 will function in reactor 16 to supply labile hydrogen where needed to stabilize SRC components and are thus themselves converted to the hydrogen-poor counterparts which have the high solvent power needed in the first stage low temperature dissolver 12. Those solvent species together with the high solvent power monocyclic phenols derived from the coal constitute important components of recycle solvent taken off the effluent of reactor 16 in separator 23 which also has the function of removing any solids present for discharge by line 24.

The recycle solvent will be a fraction from the total effluent adequate in amount to satisfy needs of dissolver 12 and boiling generally below about 500° C. Before transfer to line 11, the recycle solvent is stabilized by removal of normally gaseous components boiling below about 35°–40° C. which are discharged by a conduit not shown for use as fuel, chemical feed stock and the like, all in manner conventional in the art.

As will be apparent to those skilled in this art, the treatment parameters will vary depending on nature of the coal, desired end use of the SRC, means available for transport of SRC and the like. In general, the recycled solvent will have a boiling range above about 30° C. and not higher than 500° C., preferably 180° C. to about 460° C. and will be supplied at a weight ratio to coal between 1 and 6. Conditions in the first stage dissolver will be temperatures of about 400° C. to about 460° C. and pressures between 500 and 3000 psig. Flash separator 13 or 18 will be operated at temperature and pressure to vaporize material boiling below about 300° C., preferably below about 275° C., it being recognized that flash distillation is relatively inefficient, taking overhead some portion of components boiling above the "cut point" and leaving some portion of the lighter components dissolved in the liquid phase. The second stage generally operates at temperatures between 400° C. and 480° C., preferably between about 420° C. and 460° C. under a pressure of say 500 to 3000 psig.

In practicing preferred embodiments of the invention, there is little or no mineral solids content of the material in reactor 16 to catalyze hydrogenation of components which could thereupon function as hydrogen donors. Hydrogen, if present, is therefore partly a diluent occupying reactor space. Although use of diluents is considered to be within the scope of the invention, it is therefore within the scope of this invention to operate without addition of elemental hydrogen.

One reason for removing solids in the two-stage process described above is to avoid their acting as surfaces and possibly catalysts for char formation. According to the present invention, this effect is reduced because the solvent is hydrogen-rich. Therefore, solids separator 17 is run at an inexpensive reduced efficiency; or, optionally, it may act on only a portion of the stream, the remainder of the solids being removed in separator 23. Thus, more of the undissolved coal, which is a portion of the solids, might be dissolved in reactor 16. A solids-rich slurry withdrawn from separator 13 can be recycled to the first stage reactor where additional dissolution can take place. A portion of this slurry can be removed in order to remove solids from the system, as must be accomplished, or there can be another separator 22 for further solids removal. Only separator 23 need be highly efficient to produce an ash-free SRC product. This separator is the easiest to run at high efficiency because the solids content, solvent viscosity, and SRC polarity and molecular weight are all lowest at this point. The slurry optionally removed after separator 13, and the solids removed from any and all separators, can be burned for process heat or used in hydrogen generation.

External catalytic rehydrogenation of process solvent is known, but not between stages in a two-stage process and treating only the lower boiling range. The concept of using cheap, inefficient separators for most of the solids removal, the optional addition of rehydrogenated recycle solvent before the solids separation (which, for instance, would improve the operation of a settler by reducing solvent viscosity), and the fact that $C_{10}+$ phenols may be hydrogen donors are all unique to the present invention.

The invention thus improves coal liquefaction by alleviating the problems associated with hydrogen depletion of solvents, increasing the efficiency of hydrogen utilization, increasing throughput (or decreasing second-stage reactor size), improving complete solids separation where required, and allowing inefficient solids separation where appropriate.

We claim:

1. In a process for solvent refining of coal by mixing comminuted coal in a first stage with a solvent derived in the process as recited hereinafter, reacting the mixed coal and solvent in a second stage characterized by presence of hydrogen donor compounds, separating undissolved solids, and separately recovering from the product of reacting coal a solvent refined coal product of low melting point and a solvent fraction for mixing with comminuted coal in said first stage; the improvement which comprises separating from the mixture produced in said first stage a light fraction boiling below about 275° C. and containing compounds of about fourteen carbon atoms and less derived from said mixture, subjecting said light fraction to catalytic hydrogenation under conditions to reduce the monocyclic phenol content thereof and to convert polycyclic aromatic hydrocarbons to hydrogen donors, passing to said second stage the residue of solvent and coal from which said light fraction has been removed, and adding said hydrogenated light fraction to the reactants for said second stage.

2. A process according to claim 1 wherein undissolved solids are separated from said mixture before reacting the same in said second stage.

3. A process according to claim 2 wherein said hydrogenated light fraction is added to said reactants before separation of said undissolved solids.

* * * * *

UNITED STATES PATENT AND TRADEMARK OFFICE

CERTIFICATE OF CORRECTION

PATENT NO. : 4,347,116

DATED : August 31, 1982

INVENTOR(S) : Darrel D. Whitehurst et al.

It is certified that error appears in the above-identified patent and that said Letters Patent are hereby corrected as shown below:

On Title Page: "[73] Assignee: Mobil Oil Corporation" should be -- Electric Power Research Institute Palo Alto, Calif. --.

Column 1, line 52" "unreached" should be -- unreacted --.

Column 7, line 22: "260° 14 400°C" should be -- 260° - 400°C --.

Signed and Sealed this

Twenty-eighth Day of December 1982

[SEAL]

Attest:

GERALD J. MOSSINGHOFF

Attesting Officer

Commissioner of Patents and Trademarks